US005207494A

United States Patent [19]

Jones

[11] Patent Number: 5,207,494

[45] Date of Patent: May 4, 1993

[54] DIMMER FOR FIBER OPTIC SYSTEMS

[75] Inventor: Eric M. Jones, Los Angeles, Calif.

[73] Assignee: Karl Storz Endoscopy-America, Inc., Culver City, Calif.

[21] Appl. No.: 644,793

[22] Filed: Feb. 4, 1991

[51] Int. Cl.[5] ..... F21V 7/04

[52] U.S. Cl. ..... 362/32; 362/281; 362/321; 362/323; 362/324

[58] Field of Search ..... 362/32, 277, 280, 281, 362/282, 283, 290, 319, 321, 322, 323, 324, 325

[56] References Cited

U.S. PATENT DOCUMENTS 4,210,955 7/1980 Labrum ..... 362/321
4,233,650 11/1980 Hagner et al. ..... 362/32
4,811,182 3/1989 Salomon ..... 362/321

FOREIGN PATENT DOCUMENTS 45976 1/1911 Fed. Rep. of Germany ..... 362/323
272507 2/1928 United Kingdom ..... 362/325

*Primary Examiner*—Ira S. Lazarus
*Assistant Examiner*—Y. Quach
*Attorney, Agent, or Firm*—Donald D. Mon

[57] ABSTRACT

A dimmer for variably adjusting light transmitted through it to a fiber optic bundle from a light source whose own intensity is not to be adjusted. A body has an axial passage for light to pass through. A plurality of opaque vanes is symetrically arranged in the passage. They meet at an apex located on the axis. Each vane has an axis of rotation in a plane normal to the axis and are rotatable to vary the amount of light which is transmitted. These vanes are coordinated for simultaneous and identical rotation.

6 Claims, 2 Drawing Sheets

DIMMER FOR FIBER OPTIC SYSTEMS

Field of the Invention

This invention relates to apparatus for variably adjusting the light intensity output of a fiber optic light transmission system.

Background of the Invention

Fiber optic systems such as are used in endoscopic surgery utilize as a light source a very high intensity lamp whose own intensity output cannot effectively be varied. Attempts to vary its output can involve complications such as color change of the light, which should be avoided in surgical applications, and early loss of the electrode. Accordingly, recourse is had to mechanical devices that occlude part of the light path, so that less total light is transmitted, however at the same color and unit intensity as emitted from the lamp whose intensity is constant.

This general approach to varying light intensity is widely used in many optical systems, especially lens type systems, in which it is quite successful. It is used in some fiber optic systems, also, but with lesser degrees of acceptability. This is because of the unique transmission properties of optical fibers and bundles of optical fibers.

An optical fiber which receives a converging beam of light emits a beam which is rotationally faithful to its source. As a consequence, when a portion of a beam converging on the fiber or on the bundle is occluded by most conventional devices, exit patterns are produced whose brightness varies significantly across it. In some fields of work this is tolerable, but in endoscopic surgery it is not.

Frequently the output of conventionally dimmed systems involves a phenomenon knows as "ringing", in which situation there are alternate brighter and dimmer, even dark, regions. A small movement of the instrument can result in a lesser illumination on a critical surgical area. Quite sophisticated efforts have been made to avoid this situation. For example Volpi 4,425,599 shows one. Still the output is not uniform across the beam.

It is an object of this invention to provide a mechanical dimmer which occludes fractions of a beam from a light source to a fiber optic system that can vary the intensity of the output beam while still providing substantially uniform light intensity over the entire area illuminated by the output beam as emitted from the fiber optics.

Brief Description of the Invention

An illumination system according to this invention is disposed in a reference plane that is normal to the optical axis of a light beam convergent upon the upstream end of a fiber optic bundle. A plurality of rotatable wedge-shaped vanes is mounted to a supporting body. Each vane has an apex and a pair of edges which diverge from the apex. Each pair of diverging edges bounds a wedge-shaped opaque area. Each vane is rotatable around a respective axis of vane rotation. Each axis of vane rotation lies in the reference plane and extends as a radius from the optical axis to the boundary of the light beam. Each axis of vane rotation is the bisector of the vertex angle formed by the diverging edges.

Rotation means is coupled to the vanes to rotate them simultaneously around their respective axes of vane rotation. As a consequence of this rotation, the area of the beam occluded by the respective vanes can be adjusted from nearly complete occlusion when the vane is in the reference plane, to an area about equal to the total thickness of the vane material when the plane of the vanes is parallel to the optical axis and normal to the reference plane. This is an adjustment from nearly complete occlusion to nearly complete transmission.

According to a feature of this invention, the spacing between adjacent vanes as viewed along the optical axis extends from the optical axis along a radius of the beam, with its occlusive effectiveness a function of the angle of the vane relative to the reference plane.

The above and other features of this invention will be fully understood from the following detailed description and the accompanying drawings, in which:

DETAILED DESCRIPTION OF THE INVENTION

Figure 1:
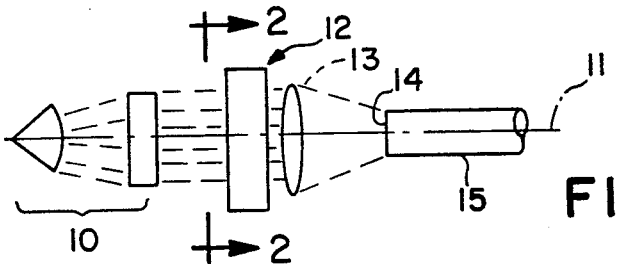
FIG. 1 is a schematic showing of an optical system utilizing the invention.

FIG. 1 shows a collimated light source 10 projected along a central optical axis 11. The beam impinges on a dimmer 12 according to this invention. It passes through the dimmer and impinges on a lens 13 which focuses the light on the upstream end 14 of a fiber optic bundle 15.

The dimmer includes a body 20 with a central passage 21. A fully transmissive plate 22 closes one end of the passage. Lens 13 closes the other end.

The body supports six opaque vanes 25, 26, 27, 28, 29 and 30. They are all identical, so only vane 25 will be described in detail. Each vane has two straight sides 31, 32, which meet at an apex 33. It has an arcuate outer edge 34. The vane is pivotally mounted to the body. Its axis of rotation is the bisector of the angle at the vertex, lies in a plane normal to the central axis, and extends along a radius of the beam from the central axis.

Figure 5:
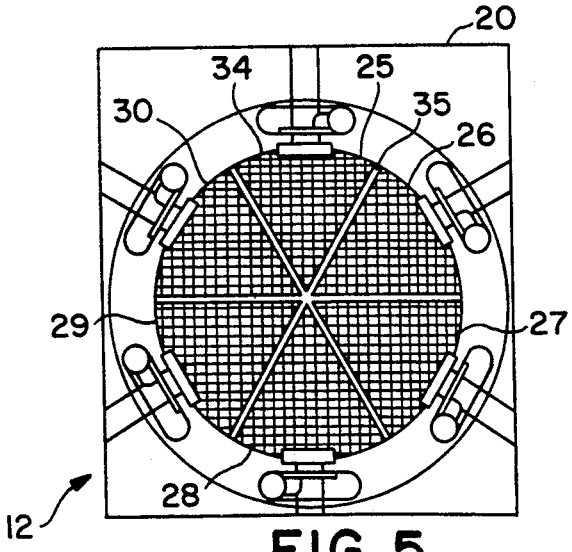
FIG. 5 is a side view showing full occlusion.
Figure 6:
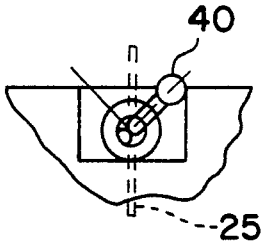
FIG. 6 shows the control arrangement respective to FIG. 1.
Figure 7:
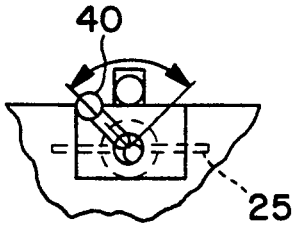
FIG. 7 shows the control arrangement respective to full transmission as shown in FIGS. 1 and 2.

As can best be seen in FIG. 5, which shows full occlusion, the vanes are placed as close to each other as possible, and the apex is placed as close to the central axis as possible, leaving only spacings 35 between them sufficient to provide clearances when the vanes are rotated. These spacings constitute a light "leak" which enables some light to pass (see FIG. 8) However, the placement of the vanes is as close as possible to contiguity, and this spacing apart falls within the defined scope of the invention.

In FIG. 1, where maximum transmission occurs, the vanes as shown have a dimension of thickness, which occludes some of the light beam. The remainder of the beam area is not occluded. This does reduce the maximum transmission to a small extent (see FIG. 8).

Central shaft 37 is journaled in the body and projects beyond it. Vane 25 is mounted to it. A coordination ring 38 is rotatably mounted to the body. It has a group of slots 39, one respective to each vane, which receives a lever 40 this forms part of a shaft which rotatably mounts each vane, just as vane 25 is mounted to shaft 37. Suitable clearances are provided so that rotation of the ring moves all of the levers together to turn the vanes equally around their axes.

It is important to note that the areas of light transmission extend from the center outward to the edge of the beam. This is different from occlusion along a chord, for example. Chord-like transmission results in ringing. Full radial occlusion does not.

The phenomenon of ringing, and the importance of apertures from center to edge is fully disclosed in applicant's U.S. patent application Ser. No. 07/491,562 filed Mar. 9, 1990 entitled "Dimmer for Fiber Optic Light Transmission Systems now U.S. Pat. No. 5,006,965 issued Apr. 9, 1991," which is incorporated in its entirety by reference. This invention provides many of the advantages of this referenced patent and utilizes the concept of transmission along a radius.

Figure 8:
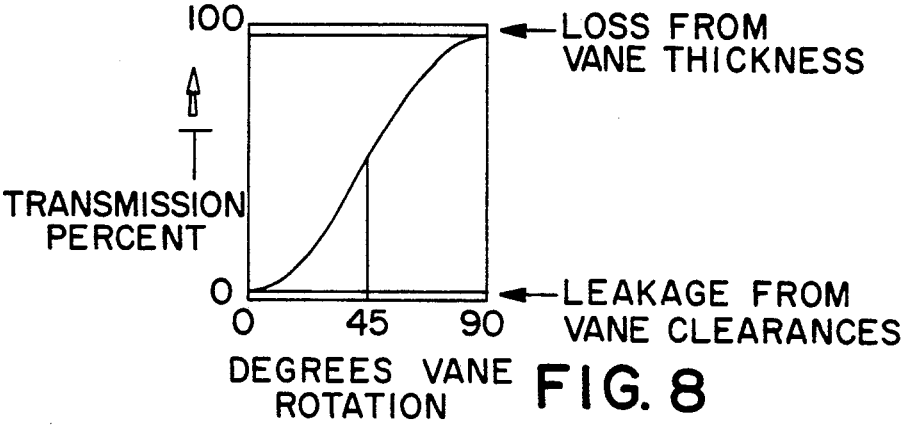
FIG. 8 is a graph showing the dimming characteristics of the invention.

In particular, in FIG. 8, its nearly-linear output as a function of vane rotation is shown. At zero degrees rotation (the position of FIG. 5), "leakage" is shown. At 90 degrees (FIG. 1), the loss of light from vane thickness is shown.

Figure 2:
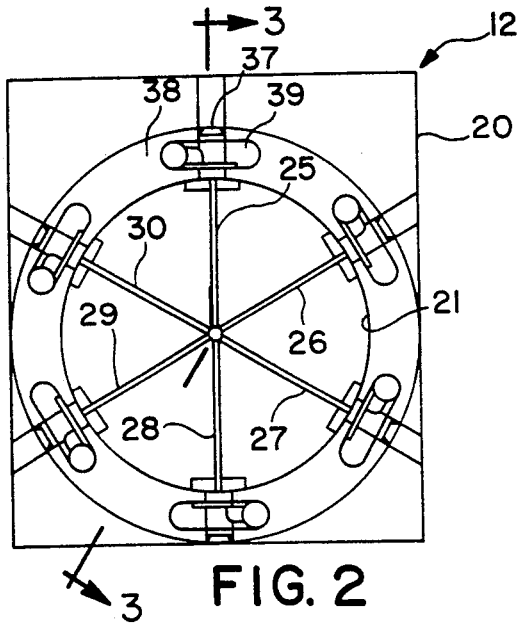
FIG. 2 is a side view taken at line 2—2 in FIG. 1 of the presently preferred embodiment of the invention.
Figure 3:
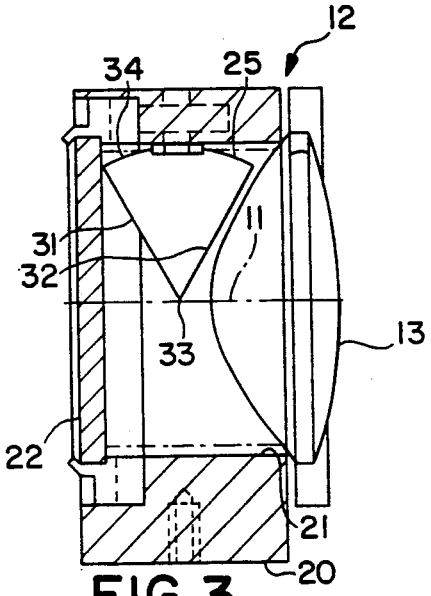
FIG. 3 is a cross-section taken at line 3—3 in FIG. 2.
Figure 4:
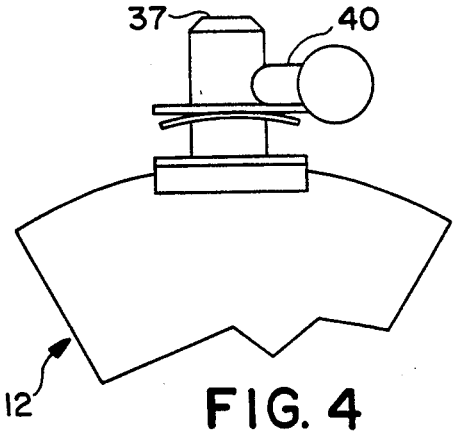
FIG. 4 is a fragmentary side view of a portion of FIG. 2.
Figure 9:
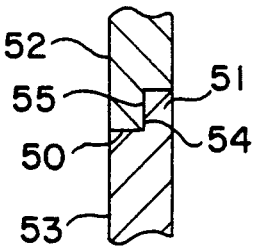
FIG. 9 shows a modification of the edges of adjacent vanes.

FIG. 9 shows the edges 50, 51 of two adjacent vanes 52, 53. Each has a step 54, 55 complimentary to the other to close the spacing between them at full occlusion, thereby eliminating the light leak inherent in the construction of FIG. 2. However, this complexity may not be justified in order to eliminate the minor problem of light leakage at full occlusion, and is optional.

Figure 10:
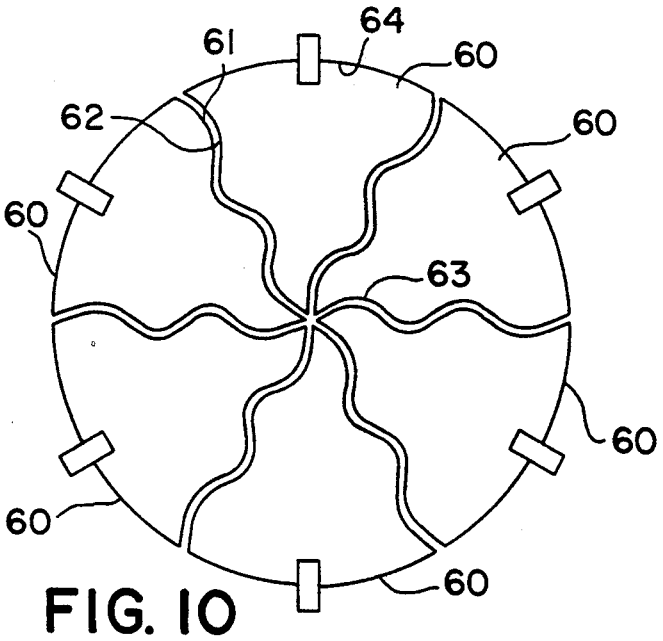
FIG. 10 shows another edge configuration for the vanes.

FIG. 10 illustrates the fact that the edges of the vanes need not be straight or on or close to a radius. Instead, the spacing between them must begin at the center and extend continuously along some path to the edges of the projected beam.

Six vanes 60 are shown in their assembled, occluding position. Opposed, complementary edges 61, 16 are formed on adjacent vanes. A serpentine shape is shown as an illustrative example extending from central axis 63 to edge 64 of the beam. The function and operation of these vanes is identical to that of vance with straight edges, although some variation in the illumination pattern may occur.

Also, the axis of rotation may not precisely bisect the apex angle, although with many designs it will.

This invention thereby provides in a very simple construction a means for reducing light transmitted to a fiber optic bundle with minimal variations across the field of illumination.

This invention is not to be limited by the embodiments shown in the drawings and described in the description, which are given by way of example and not of limitation, but only in accordance with the scope of the appended claims.

I claim:

1. A dimmer for variably adjusting light transmitted through it to a fiber optic bundles from a light source whose own intensity is not to be adjusted, said light source providing a beam to said dimmer along a central optical axis, said dimmer comprising:

a body having an axially-extending passage therethrough;

a plurality of vanes in said passage arranged symmetrically in said passage, each said vane comprising an opaque body having a pair of boundary edges meeting at an apex, said apex being disposed at said central optical axis, each vane being mounted for rotation around an axis of rotation which axis of rotation lies in a plane normal to the central optical axis, and extends radially from said central optical axis, said plurality of vanes when lying in said plane occluding at least the major portion of the beam, and when lying parallel to said central optical axis, extending into said passage, but occluding a lesser portion; and coordinating means rotating all said plurality of vanes simultaneously to vary the portion of the beam which is to be occluded.

2. A dimmer according to claim 1 in which each said plurality of vanes is mounted to a respective shaft whose axis of rotation is in said plane and extends radially; a lever attached to each said shaft, and a rotatable ring engaging each said lever to turn the levers and the plurality of vanes.

3. A dimmer according to claim 1 in which said boundary edges are straight, meet at an apex angle and in which the axis of rotation is on the bisector of the apex angle.

4. A dimmer according to claim 3 in which said boundary edges include a complementary step which with a boundary edge on its neighbor vane fully occludes the spacing between the plurality of vanes when the plurality of vanes lie in a plane normal to the central optical axis.

5. A dimmer according to claim 1 in which the edges of adjacent vanes extend away from the central optical axis along a nonlinear path to the edge of said beam.

6. A dimmer according to claim 1 in which said edges are serpentine-shaped.

* * * * *